United States Patent [19]

Takehara et al.

[11] 4,297,396

[45] Oct. 27, 1981

[54] COATING METHOD

[75] Inventors: Nobumitsu Takehara; Shogo Isayama, both of Minami-ashigara, Japan

[73] Assignee: Fuji Photo Film Co., Ltd., Minami-ashigara, Japan

[21] Appl. No.: 101,383

[22] Filed: Dec. 7, 1979

[30] Foreign Application Priority Data

Dec. 19, 1978 [JP] Japan ..... 53-158762

[51] Int. Cl.[3] ..... B05D 5/00

[52] U.S. Cl. ..... 427/284; 118/50; 118/411; 427/128

[58] Field of Search ..... 427/131, 209, 128, 284; 118/50, 407, 411, 412

[56] References Cited

U.S. PATENT DOCUMENTS 2,975,754 3/1961 Wright ..... 118/407

3,573,965 4/1971 Ishiwata et al. ..... 117/83

*Primary Examiner*—Bernard D. Pianalto

*Attorney, Agent, or Firm*—Sughrue, Mion, Zinn, Macpeak & Seas

[57] ABSTRACT

A slide bead coating method and apparatus wherein a first coating liquid is supplied from a center portion of a slide surface and a second coating liquid is supplied along edge portions thereof contiguous to the flow of the first coating liquid. The second coating liquid has a viscosity lower than that of the first coating liquid and a flow rate which is also lower than that of the first coating liquid. In this manner, breakage of both end portions of the bead is prevented without coating both end portions thicker than the center portion while yet a high coating speed operation is attained.

8 Claims, 2 Drawing Figures

COATING METHOD

BACKGROUND OF THE INVENTION

This invention relates to a method for applying a liquid coating compound to a long, flexible support or web being conveyed.

A conventional coating method which has been extensively employed for applying a liquid coating compound or coating liquid to a web in a method using a so-called "multilayer slide bead coating apparatus" is disclosed, for example, in U.S. Pat. No. 2,716,791 issued to Russell et al. According to this conventional method, plural coating liquids flow down a slide surface falling against the web being conveyed to form a bead thereon. With a coating apparatus of this type, it is essential to maintain the bead stable. However, as the coating speed is increased, it usually becomes difficult to maintain the stability of the bead.

U.S. Pat. No. 2,681,294 discloses a technique in which means for reducing the pressure on the lower surface of the bead is used to provide a difference in pressure between the upper surface and the lower surface of the bead thereby to maintain the bead stable. However, the stability of the bead depends not only the balance in pressure between the upper and lower surfaces of the bead. That is, the widthwise balance of the bead, namely the stability at both ends of the bead, must be also taken into consideration. This can by understood from the fact that, as the coating speed is increased, breakage of the bead begins with the two ends thereof.

In order to prevent the bead from being broken in this way, a method has been proposed in the art in which the flow rate of coating liquid at the two ends of the bead is made higher than that at the remaining portions of the bead. However, this method is not suitable for most applications because with it the thickness at both edge portions of a layer is greater than that of the remaining portions thereof. Also, it may be difficult to completely dry both edge portions with the same process.

Accordingly, an object of the invention is to provide a coating method in which all of the above-described difficulties accompanying a conventional method have been eliminated and in which breakage of both end portions of the bead is prevented without coating both end portions thicker and yet in which a high speed coating operation is possible.

SUMMARY OF THE INVENTION

The foregoing object and other objects of the invention have been achieved by the provision of a slide bead coating method in which, according to the invention, coating is carried out by supplying a second coating liquid having a lower viscosity than an original coating liquid at a flow rate lower than that of the original coating liquid to both ends of a slide surface. Preferably, the second liquid is supplied through apatures in guide plates disposed at both sides of the slide surface.

Also, the invention may be practiced by apparatus for applying first and second coating liquids to a moving web including a coating head block having at least one slit therein for supplying the first coating liquid to a slide surface formed on the coating head block, first and second guide plates disposed on the slide surface of the coating head block wherein the flow of the first coating liquid from the slit is confined to between the guide plates on the slide surface and each of the guide plates has an aperture therein for supplying a second coating liquid upon portions of the slide surface contiguous to the flow of the first coating liquid, means for supplying the first coating liquid to the slit, and means for supplying the second coating liquid to the apertures. Preferably, the second coating liquid is supplied at a flow rate lower than the flow rate of the first coating liquid and the viscosity of the second coating liquid is lower than that of the first coating liquid. Also, preferably the apertures are formed at an end edge portion of the slide surface.

DESCRIPTION OF THE PREFERRED EMBODIMENTS

The invention will be described in detail with reference to the accompanying drawings.

Figure 1:
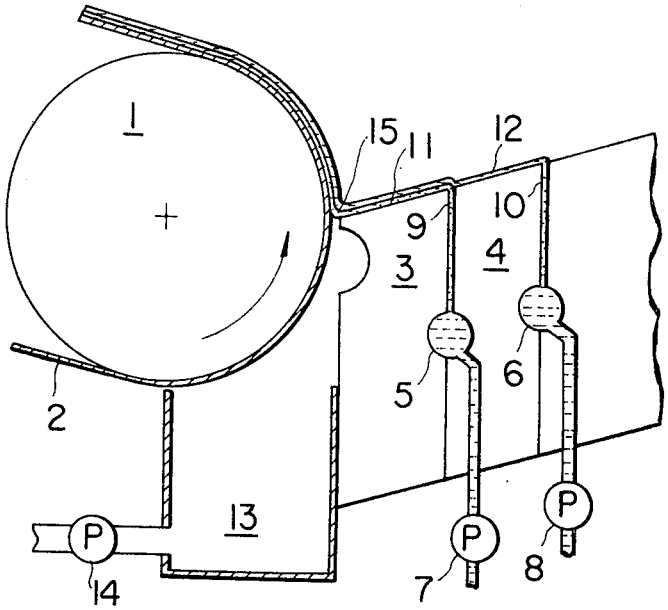
FIG. 1 is a side view of a conventional slide bead coating apparatus.

FIG. 1 is a side view of a conventional slide bead coating apparatus. In the coating apparatus, coating liquids 11 and 12 supplied by slide hopper type coating heads 3 and 4 are applied to a web 2 which is formed a bead 15. The web 2 is conveyed by a back-up roll 1. The coating apparatus includes coating liquid supplying pumps 7 and 8, cavities 5 and 6, slots 9 and 10, and a pressure reducing chamber 13 connected to a suction blower 14. The pressure reducing chamber 13 is adapted to reduce the pressure on the rear surface (the lower surface as viewed in the figure) of the bead 15.

Figure 2:
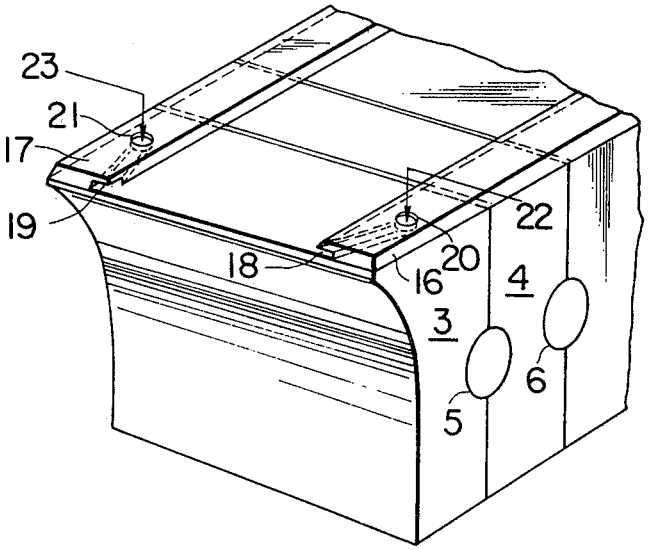
FIG. 2 is a perspective view showing a preferred embodiment of a coating apparatus of the invention.

FIG. 2 is a perspective view (with parts cut away) showing a part of a slide bead coating apparatus according to one embodiment of this invention. The specific feature of this embodiment resides in the following points. In the conventional coating apparatus, at least one coating liquid is supplied uniformly over the entire width of the slide hopper for application to the web. On the other hand, in the embodiment of the invention, a first coating liquid (hereinafter referred to as "an original coating liquid" when applicable) is supplied in contact with side plates 16 and 17 provided on both edges of the slide hopper while second coating liquids 22 and 23, lower in viscosity than the original coating liquid, are supplied to both sides of the original coating liquid to coat the web therewith.

The second coating liquids 22 and 23 are supplied through liquid supplying inlets 20 and 21 and are discharged from discharging outlets 18 and 19, respectively, so as to be coated over the layer of original coating liquid. In FIG. 2, the discharging outlets 18 and 19 are provided at the end of the slide hopper. However, they may be provided at an upstream position on the slide hopper. The second liquids used herein are such that they will not spoil the physical properties of the original coating liquid and have a surface tension that can hold both edges of the bead. Furthermore, it is desirable that the second coating liquids be lower in viscosity than the original coating liquid.

That is, in general, in a slide bead coating method, as the viscosity of the coating liquid is decreased, the coating speed can be increased. However, as the coating speed is increased, the load for drying the layer of coating liquid is increased. If the density of the coating liquid is increased (the water percentage is decreased) in order to decrease the load, then the viscosity of the coating liquid is increased. On the other hand, in order to prevent the surface of the film of coating liquid from becoming uneven, the viscosity must be higher than a certain value, such as 10 to 100 cp. Therefore it may be unavoidable that the viscosity of the coating liquid be increased.

The inventors have performed intensive research on the stabilization of the bead as a result of which it has been found that the bead can be stabilized by supplying the second coating liquids lower in viscosity at both ends of the coating head. By employing this method, both edges of the bead, which otherwise would be readily broken, can be reinforced. Accordingly, the web can be stably coated with the coating liquid even in a high speed coating operation.

The coating liquids employable in the invention are not specifically limited. However, the coating apparatus according to the invention is most effectively applicable to manufacturing photographing photo-sensitive materials, magnetic recording materials, and pressure-sensitive copying sheets.

In the case where the coating method of the invention is used to manufacture photographing photo-sensitive materials, methods of preparing photographing coating liquids, compounds and additives, materials of webs, the various treatments involved may be such as those disclosed in the specifications Japanese Published patent applications Nos. 14130/1974, 24133/1974 and 35447/1974. Examples of the photographing coating liquid include not only photo-sensitive liquids such as photographing emulsions but also include coating liquids such as under-coating liquids, antihalation coating liquids and back-layer coating liquids which are used to manufacture photographing photo-sensitive materials.

In the case where the coating method of the invention is used in the manufacture of magnetic recording materials, a particular method of manufacturing coating liquids for magnetic recording materials, compounds and necessary additives, web materials, various treatments and the like, may be such as those disclosed in the specification of Japanese patent application No. 154491/1976. Examples of coating liquids suitable for magnetic recording materials include all of the coating liquids such as magnetic coating liquids and back coating liquids which are customarily employed in the manufacture of magnetic recording materials.

Should the coating method according to the invention be used to manufacture magnetic recording materials as described above, it is necessary to satisfy particular conditions peculiar to magnetic recording materials so that the orientation characteristics of a film made from a coating liquid is improved by providing an orientating device and the stability of the film is also improved. For such purposes, the techniques disclosed in the specification of Japanese patent application No. 96675/1976 can be utilized.

In the case where the coating method according to the invention is utilized to manufacture pressure-sensitive copying sheets, methods of preparing coating liquids for pressure-sensitive copying sheets, compounds and necessary additives, web materials, suitable treatments, and the like may be as disclosed in the specification of Japanese patent application No. 76743/1976.

Examples of coating liquids for pressure-sensitive copying sheets include all of the usual coating liquids such as coating liquids containing microcapsules and coating liquids containing a developer.

In applying the coating method of the invention to the manufacture of pressure-sensitive copying sheets, it is necessary to satisfy conditions peculiar to coating liquids for pressure-sensitive copying sheets. For this purpose, the techniques of Japanese patent application No. 76743/1976 can be utilized.

The coating method of the invention is effective especially for coating webs with suitable coating liquids in the manufacture of photographing photo-sensitive materials. Examples of the second coating liquids low in viscosity which are suitable in this case are aqueous solutions of various surface active agents of low viscosity gelatin aqueous solutions of surface active agents. For example, there can be used nonionic surface active agents such as saponin (steroid series), alkylene oxide derivatives (e.g., polyethylene glycol, polyethylene glycol/polypropylene glycol condensate, polyethylene glycol alkyl or alkylaryl ether, polyethylene glycol esters, polyethylene glycol sorbitan esters, polyalkylene glycol alkylamine or amides, polyethylene oxide adducts of silicone, etc.), glycidol derivatives (e.g., alkenylsuccinic acid polyglyceride, alkylphenol polyglyceride, etc.) fatty acid esters of polyhydric alcohols, sugar alkyl esters, urethanes, ethers, etc.; anionic surface active agents containing acidic groups (such as carboxy group, sulfo group, phospho group, sulfuric ester group, phosphoric ester group, etc.) such as triterpenoid series saponin, alkylcarboxylic acid salts, alkylsulfonic acid salts, alkylbenzenesulfonic acid salts, alkylnaphthalenesulfonic acid salts, alkylsulfuric esters, alkylphosphoric esters, N-acyl-N-alkyltaurines, sulfosuccinic esters, sulfo-alkylpolyoxyethylene alkylphenyl ethers, polyoxyethylene alkylphosphates, etc.; amphoteric surface active agents such as amino acides, aminoalkylsulfonic acids, aminoalkylsulfuric or phosphoric esters, alkylbetaines, amineimides, amine oxides, etc.; and cationic surface active agents such as alkylamines, aliphatic or aromatic quaternary ammonium salts, heterocyclic quaternary ammonium salts (e.g., pyridinium, imidazolium, etc.), aliphatic or hetero ring-containing phosphonium or sulfonium salts, etc.

Specific examples of these surface active agents are described in U.S. Pat. Nos. 2,240,472, 2,831,766, 3,158,484, 3,210,191, 3,294,540, 3,507,660, 2,739,891, 2,823,123, 3,068,101, 3,415,649, 3,666,478, 3,756,828, 3,133,816, 3,441,413, 3,475,174, 3,545,974, 3,726,683, 3,843,368, 2,271,623, 2,288,226, 2,944,900, 3,253,919, 3,671,247, 3,722,021, 3,589,906, 3,666,478, and 3,574,924 and British Pat. Nos. 1,012,495, 1,022,878, 1,179,290, 1,198,450, 1,397,218, 1,138,514, 1,159,825, 1,374,780, 1,507,961, and 1,503,218.

A specific example of an implementation of the invention will be described in order to clarify the effects of the invention.

EXAMPLE

A single layer of coating liquid was coated on a web using the slide bead coating apparatus shown in FIG. 1 and FIG. 2. The coating liquid was constituted and had physical properties as indicated in Table 1 below:

The web used was a polyethyleneterephthalate film 180μ in thickness and 18 cm in width. The flow rate of the coating liquid was 20 cc/cm.min at the minimum and the bead back pressure was −20 mmAq. Under these conditions, after the coating liquid was applied to the web at a low speed, the coating speed was gradually and continuously increased and the coating speed at which the bead finally was broken (hereinafter referred to as "a maximum coating speed" when applicable) was measured.

With the coating apparatus shown in FIG. 1, the maximum coating speed was found to be 37 m/min corresponding to an amount of coating of 54.1 cc/m$^2$.

In the case where the coating apparatus shown in FIG. 2 was used with a liquid prepared by adding a surface active agent to water as the second coating liquid low in viscosity, the results were as follows:

| Low viscosity coating liquid flow rate | Maximum coating speed | Amount of coating |
|---|---|---|
| 10 cc/cm min. | 134 m/min | 14.9 cc/m$^2$ |
| 20 cc/cm min. | 182 m/min | 11.0 cc/m$^2$ |
| 30 cc/cm min. | 215 m/min | 9.3 cc/m$^2$ |

The width of the low viscosity coating liquid coated on each side was 3 mm.

TABLE 1

| | |
|---|---|
| Gelatin | 70 wt. parts |
| Sodium dodecylbenzene sulfonate | 1 wt. part |
| Poly(potassium p-vinylbenzene sulfonate) | 0.6 wt. part |
| Water | 928.4 wt. parts |
| Viscosity | 40 cp (measured at 40° C.) |
| Surface tension | 40 dyne/cm (measured at 40° C.) |

What is claimed is:

1. A slide bead coating method comprising the steps of: supplying a first coating liquid over at least a portion of a slide surface between guide plates disposed on both sides of said slide surface and supplying a second coating liquid lower in viscosity than said first coating liquid at a flow rate lower than that of said first coating liquid to both sides of said slide surface through an aperture in each of said guide plates.

2. The method of claim 1 wherein said first and second coating liquids combine to form a single-layer coating.

3. The method of claim 1 further comprising coating edge portions of a web with said second coating liquid and coating the portion of the web between said edge portions with said first coating liquid.

4. The method of claim 3 further comprising coating said web at a high rate of speed while preventing breakage of the coating at the edges of the web without making the coating at the edges of the web thicker than the coating therebetween.

5. Apparatus for applying first and second coating liquids to a moving web comprising:

a coating head block having at least one slit therein for supplying said first coating liquid to a slide surface thereof;

first and second guide plates disposed on said slide surface of said coating head block, supplying of said first coating liquid from said slit being confined to a flow along said slit surface between said guide plates, each of said guide plates having an aperture therein for supplying a second coating liquid upon portions of said slide surface contiguous to said flow of said first coating liquid;

means for supplying said first coating liquid to said slit; and means for supplying said second coating liquid to said apertures;

6. The coating liquid applying apparatus of claim 5 wherein said second coating liquid is supplied at a flow rate lower than the flow rate of said first coating liquid.

7. The coating liquid applying apparatus of claim 6 wherein the viscosity of said second coating liquid is lower than that of said first coating liquid.

8. The coating liquid applying apparatus of any of claims 5, 6 and 7 wherein said apertures form an outlet for said second coating liquid at an end edge portion of said slide surface.

* * * * *